US005110164A

United States Patent [19]

Whiteman et al.

[11] Patent Number: 5,110,164

[45] Date of Patent: May 5, 1992

[54] LATCHING APPARATUS FOR A PANEL DOOR

[75] Inventors: Paul L. Whiteman, Morgantown; William Hurst, New Holland, both of Pa.

[73] Assignee: Morgan Trailer Mfg. Co., Morgantown, Pa.

[21] Appl. No.: 766,772

[22] Filed: Sep. 27, 1991

[51] Int. Cl.[5] ..... F05C 9/00

[52] U.S. Cl. ..... 292/4; 292/7; 292/5; 292/36

[58] Field of Search ..... 292/DIG. 32, 4, 5, 6, 292/7, 26, 36, 48, 57

[56] References Cited

U.S. PATENT DOCUMENTS

| | | | |
|---|---|---|---|
| 425,323 | 4/1890 | Hornal | 292/DIG. 32 |
| 1,708,078 | 4/1920 | Bolles | 292/5 |
| 1,738,702 | 12/1929 | Haseltine | 292/7 |
| 3,737,183 | 6/1973 | Pastva, Jr. | 292/7 |
| 4,127,291 | 11/1978 | Pelcin | 292/DIG. 32 |
| 4,130,306 | 12/1978 | Brkic | 292/5 |
| 4,368,905 | 1/1983 | Hirschbein | 292/5 |
| 4,643,005 | 2/1987 | Logas | 292/5 |

FOREIGN PATENT DOCUMENTS

| | | | |
|---|---|---|---|
| 562472 | 10/1932 | Fed. Rep. of Germany | 292/5 |

*Primary Examiner*—Eric K. Nicholson
*Attorney, Agent, or Firm*—John D. Kaufman

[57] ABSTRACT

A door panel latching apparatus including first and second elongated rods telescoped together for relative sliding movement. The first rod is mounted to the door with a free end for latching near an upper door edge and free to rotate about its longitudinal axis but is prevented from moving longitudinally. The second rod is mounted to the door with a free end for latching near a lower door edge and free to rotate about its longitudinal axis and to move along its longitudinal axis. A handle is connected to the rods by a linkage for longitudinally moving the second rod when the handle is rotated about an axis perpendicular to the longitudinal axis of the rods and for rotating both rods when the handle is rotated about an axis which is coincident with the longitudinal axes of the rods.

13 Claims, 2 Drawing Sheets

FIG. 3
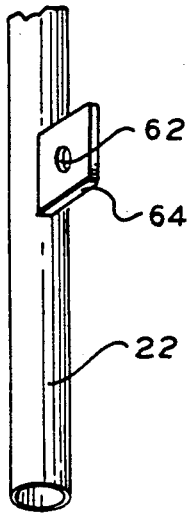
FIG. 2
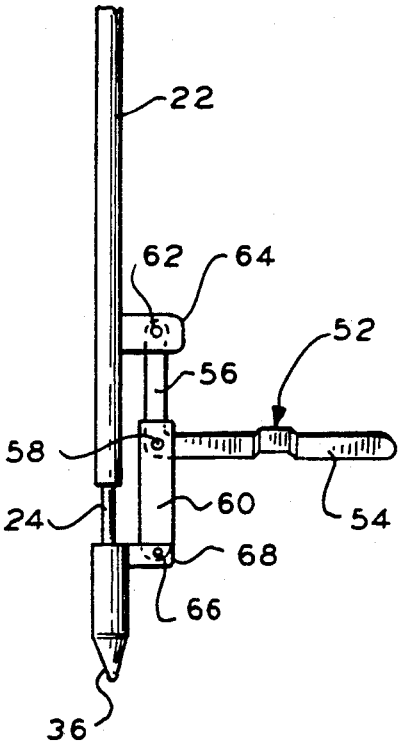
FIG. 4
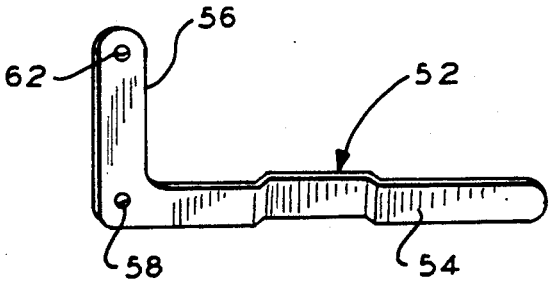
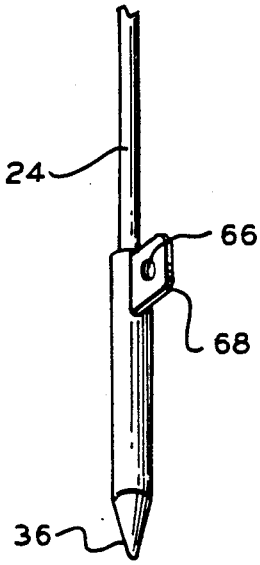
FIG. 5

LATCHING APPARATUS FOR A PANEL DOOR

BACKGROUND OF THE INVENTION

The cargo carrying portion of vans and trailers are typically closed by panel doors which may be located to the rear or to the side. These panel doors are usually hinged to open outwardly and to provide access to the interior of the van or trailer. It is desirable to positively close and to lock or latch these doors when entrance into the interior of the truck or trailer is not required during shipment of the items therewithin. An additional reason for maintaining the panel doors of such vans and trailers positively latched arises when the contents are maintained at lower temperatures. The panel doors of refrigerated vans and trailers often carry seals or gaskets which are effective only if the doors are tightly latched. Even on nonrefrigerated vehicles latching of the panel doors is usually desirable to prevent the entry of rain, water or other foreign substances into the interior.

Typical prior art latching mechanisms for panel doors in vans or trailers are generally shown in U.S. Pat. No. 4,127,291. The latching mechanisms of this patent, which are similar to those available from Eberherd Manufacturing Company of Cleveland, Ohio, include a vertical member, such as a rod or pipe, which is mounted to the door by appropriate bearing members so that the pipe is journaled for rotation while held on the door. The opposed ends of the pipe upper and lower cam or, which extend beyond the upper and lower door edges, carry latch members. Mounted to the van or trailer frame or body, so as to be adjacent to the upper and lower cam or latch members when the doors are closed are upper and lower keepers. When the doors are fully closed, the cam or latch members overlie and are adjacent to the keepers. Rotation of the pipe causes the cam or latch members to interact with the keepers so as to latch the door closed and to exert a further closing force on the door. Rotation of the pipe is achieved by a handle mounted thereto. The handle is within easy reach of a driver or other worker standing on the ground. The handle is normally held against the door by a retainer which is lockable while the van or trailer is in transit. The handle may be disengaged from the retainer and rotated away from the door. This rotation causes the cam or latch members to disengage the keepers and frees the doors for opening thereof.

It has been typical in the past where the above type of latching mechanism is used to mount or position, lift gates, lift gate extension plates, dock bumpers or the like below the level of the lower keepers. Such positioning member mounting locates the extension plate, dock bumpers or other member below the floor level of the van or trailer. This lack of coplanarity between the lift gate extension plate, dock bumper or the like, on the one hand, and the floor of the van or trailer, on the other hand, creates what is known as a "non-flush entry". In many work environments where the van or trailer is being loaded or unloaded, nonflush entry is unacceptable for cart operation. That is, many types of carts, hand trucks or other apparatus which are used to carry goods to the interior of the van or trailer traverse the nonflush entry with great difficulty or not at all.

It is not possible to mount the dock bumper, lift gate or the like in a coplanar fashion with the floor of the van or truck. Merely forming a hole through the dock bumper or other member, through which hole the lower end of the pipe and its cam or latch member extends would permit latching and unlatching but would not permit the doors to be swung open since the lower end of the pipe and the cam or latch member would continue to extend therebelow.

One technique that has been utilized in the past to avoid the above-noted problems and to permit a flush entry is to install an inside lock assembly on the interior of the panel doors. Not only does this approach not permit the doors to be positively latched in the same manner that is possible with exterior latching mechanisms, but also portions of the lock assembly may be damaged as the payload or goods within the van or trailer shift in transit.

An object of the present invention is the provision of a panel door latching apparatus which avoids the comings of the prior art noted above.

SUMMARY OF THE INVENTION

With the above and other objects in view the present invention relates to an apparatus for latching a door such as a panel door closed. The door which may be one of the doors at the rear or the side of a van or trailer, has an upper and lower edge.

The apparatus of the present invention includes a first and a second elongated rod. The rods are telescoped together or otherwise interconnected for relative longitudinal movement. A first facility mounts the first rod to the door with its free end proximate the upper door edge so that the first rod is free to rotate about its longitudinal axis but is prevented from moving longitudinally. This first facility may constitute one or more bearings in which the first member is journaled for rotation, the uppermost bearing engaging and being engaged by an enlargement near the free end of the first rod.

A second facility mounts the second rod to the door with its free end proximate the lower door edge. The second rod is free to both rotate about its longitudinal axis and to move longitudinally.

A manipulable operating handle is interconnected to the rods by a linkage facility. The linkage facility longitudinally moves the free end of the second rod toward or away from the lower door edge in response to rotation of the handle about an axis which is perpendicular to the longitudinal axes of the rods. The linkage facility also rotates the free ends of the rods in a first or second direction in response to rotation of the handle in the first or second direction about an axis which is generally coincident with the longitudinal axes of the rods.

A third facility latches or unlatches the lower edge of the closed door in responses to movement of the first end of the second rod toward or away from the lower edge. A fourth facility latches or unlatches the upper edge of the closed door in response to rotation of the free end of the first rod in the first or the second direction.

In a preferred embodiment, the third means is an aperture formed in a member such as a dock bumper, lift gate platform, lift gate extension plate or the like over which the lower door edge swings as it is opened and closed. The aperture is generally coaxial with the second rod when the door is closed. Sufficient movement of the free end of the second rod toward the lower edge of the door causes the free end of the second rod to extend beyond the lower door edge and into the aperture to latch the lower edge. Because the free end of the second rod reciprocates into an out of the aperture, the member in which the aperture is formed may be substantially coplanar with the plane of movement of the lower door edge and with the floor of the van or truck.

The third facility may also include a tapered plunger mounted to the free end of the second rod. The taper of the plunger insures its entry into the aperture and the taper may be formed so as to act against the wall of the aperture during entry thereof, so that the plunger exerts a positive closing or latching force against the lower door edge. In preferred embodiments, the plunger and its taper are coaxial with the second rod so that rotation of the second rod does not affect to the engagement, or lack thereof, between the plunger and the walls of the aperture. The plunger and its taper may also be formed so as to be non-coaxial with the second rod and/or with the aperture. In this event, the rotation of the second rod will effect a varying amount of engagement or lack of engagement between the plunger and the walls of the aperture.

In other preferred embodiments, the fourth means may constitute the typical cam or latching member and keeper arrangement at the upper edge of the door.

In a specific embodiment, the handle comprises an L-shaped member having a first leg which is manipulable. The linkage facility comprises a link pivotally connected at one end to the second rod and pivotally connected at its other end to the juncture of the legs of the handle. There is also a pivotal connection between the free end of the second leg and the first rod. In this manner, when the free end of the second rod latches the lower door edge, the second leg of the handle and the link are generally aligned and are generally parallel to the rods. When the free end of the second rod unlatches the lower door edge, the second leg of the handle and the link are not aligned and are not parallel to the rods. Unlatching or latching the lower door edge is effected by manipulation of the handle which causes it to rotate about the pivotal connection between its second leg and the first rod. This rotation decreases or increases the distance between the last noted pivotal connection and the pivotal connection between the link and the second rod. Rotation of the rods is effected by rotation of the handle which transfers totaling force to the rods via the pivotal connections.

Because the above described apparatus involves latching the lower door edge with a member which may be reciprocated upwardly so as to not interfere with the opening or the closing of the door, the apparatus of the present invention provides a convenient way of latching the panel door of a van or trailer while permitting its entry to be flush with the cargo space floor and to locate the entire mechanism on the exterior of the door where shifting loads within the van or trailer cannot damage its elements.

BRIEF DESCRIPTION OF THE DRAWING

FIGS. 2-5 illustrate a portion of the apparatus of FIG. 1 and perspective views of three major components thereof.

DETAILED DESCRIPTION

Figure 1:
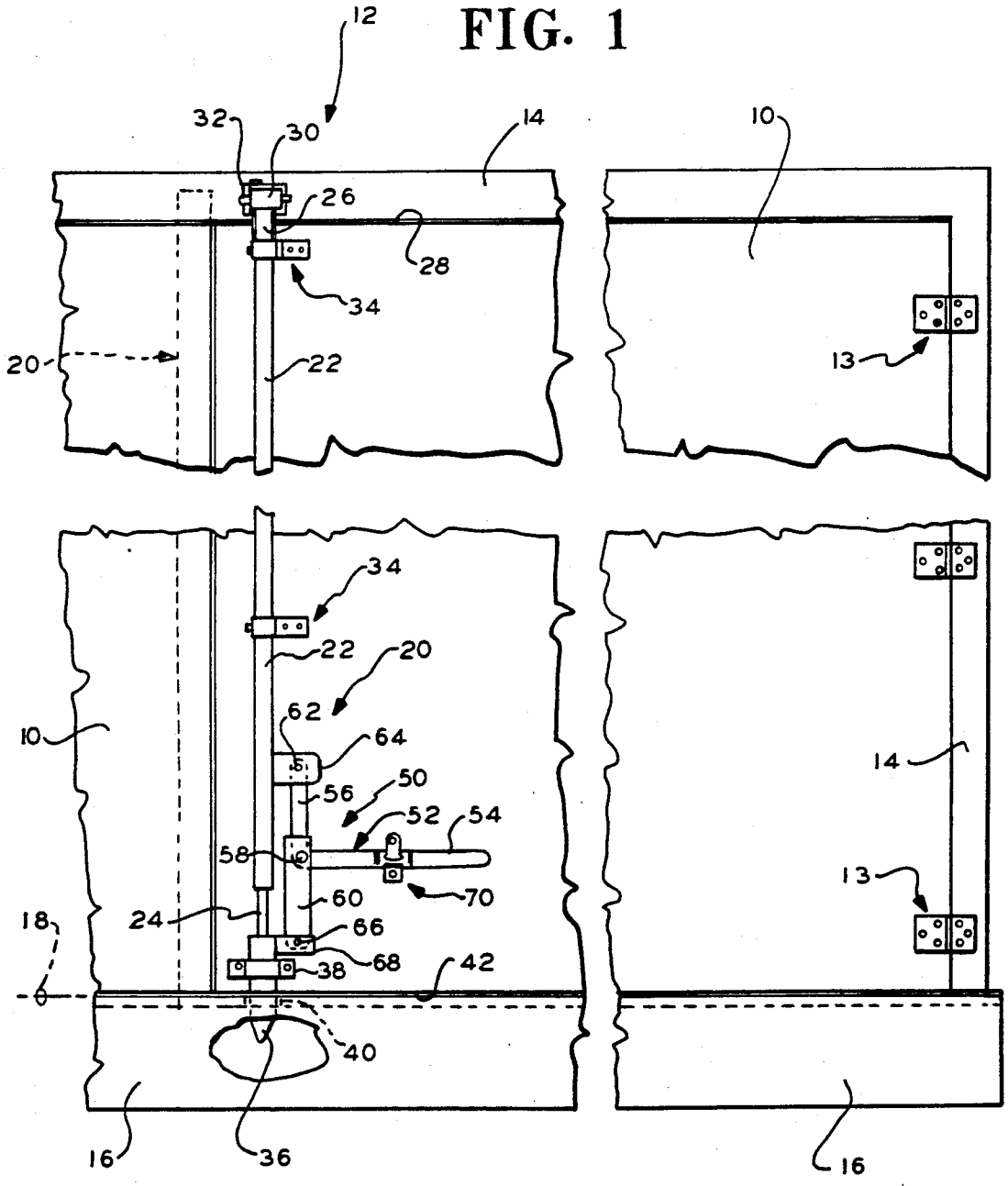
FIG. 1 is a front elevation of latching apparatus according to the present invention as viewed from the rear of a van or trailer.

Referring to FIG. 1 there is shown a portion of two panel doors 10 of a van or trailer 12. It should be understood that the doors 10 may be located at the rear or on the side of the van or trailer 12. Further, the doors 10 may be rotatably mounted at one edge by hinges 13 attached to the frame 14 of the van or trailer, and or may comprise other types of doors such as multiple folding or accordian doors.

Each panel door 10 moves toward and away from the van or trailer 12 as it is closed or opened. In the closed position of the doors 10 it is desired that the doors 10 be positively latched. Associated with the van or trailer 12 is a dock bumper, lift gate platform, liftgate extension plate or similar member, generally shown at 16. It is desirable that this member 16 be coplanar with or flush with the level 18 of the floor of the cargo carrying area of the van or trailer 12. If the member 16 and the level 18 of the floor of the van or trailer 12 are not coplanar, the use of certain types of carts or other small loading vehicles may be rendered difficult if not impossible. The apparatus 20 of the present invention (shown only on the right-hand door 10) permits the doors 10 to be latched positively and further permits the member 16 to be coplanar with the floor level 18 of the van or trailer 12.

The latching apparatus 20 according to the present invention includes a first rod or pipe 22 and a second rod or pipe 24. The rods 22 and 24 are telescoped together. In FIGS. 1 and 2, the second rod 24 is shown as inserted into the first rod 22 but the reverse telescoping arrangement is just as acceptable.

The first rod 22 carries at its upper free end 26, which is adjacent to the upper free edge 28 of the door 10, a latch member or cam 30. The latch member or cam 30 is designed to interact with a keeper 32 which is mounted to the frame 14 of the van or trailer 12 above the upper free door edge 28. Rotation of the first rod 22 in one direction causes the latch member or cam 30 to engage the keeper and to positively latch the door 10, and rotation of the rod 22 in the opposite direction permits the latch member 30 to disengage from the keeper 32. The latch member 30 and the keeper 32 may be of any type known in the prior art, and, specifically may constitute the elements shown and described in U.S. Fat. No. 4,127,291. One or more bearing members 34 may journal the rod 22 to the door 10 for rotation. One of the bearing members 34 or another expedient facility may be used to prevent the rod 22 from longitudinal movement along its axis. In the present embodiment, the latch member 30 constitutes a portion of a casting which is mounted to the free upper end 26 of the rod 22. The diameter of the casting is larger than the diameter of the rod 22. The uppermost bearing member 34 thus engages the enlarged diametric portion of the casting to prevent the longitudinal movement of the rod 22.

The second rod 24 may include a pointed or tapered member 36 which may be formed integrally with the rod 24 or may, as depicted, be a separate member which is mounted to the free end of the rod 24 in any convenient fashion. Because the rods 22 and 24 are telescoped, and because the rods 22 is prevented from longitudinal movement, the second rod 24 may move longitudinally relative to the first rod 22. The pointed or tapered member 36 is mounted to the door 10 by a bearing member 38 which journals the pointed or tapered member 36 for rotation and which also permits the pointed or tapered member 36 and the second rod 24 to move longitudinally upwardly.

Formed in the dock bumper or other member 16, which is coplanar with the wall of the van or trailer 12 is an aperture 40. This aperture 40 is formed in the member 16 so as to be vertically aligned with the pointed tapered member 36 when the door 10 is closed.

From what has been described thus far, one may observe that rotation of the first rod 22 will effect latching and unlatching of the upper free edge 28 of the door 10 and that reciprocation of the pointed tapered member 36 upwardly and downwardly will permit the lower free edge 42 of the door 10 to be unlatched or latched. Because the pointed tapered member 36 can reciprocate due to the telescoping of the rods 22 and 24, a simple aperture 40 through the member 16 permits latching of the lower free edge 42 of the door 10 to be achieved and permits the member 16 to be flush with the floor level 18 of the van or trailer, because sufficient lifting of the pointed tapered member 36 will permit the door 10 to freely swing open and closed.

An operating mechanism 50 for the structure thus far described, includes a handle 52. The handle 52 has a longer leg 54 which is intended to be manipulated by a human operator, and a shorter leg 56, the function of which is described below. The junction between the legs 54 and 56 of the handle 52 are pivoted as at 58 to one end of a link 60. The free end of the shorter leg 56 is pivoted as at 62 to the first rod 22. In preferred embodiments, this pivot 62 may be located in an ear or lug 64 which is attached as by welding or the like to the first rod 22.

The free end of the link 60 is pivoted as at 66 to the second rod 24. In preferred embodiments, this pivot 66 may be located in an ear or lug 68 attached to or formed integrally with the pointed tapered member 36.

As shown in FIG. 1, the longer leg 54 of the handle 52 may be held against the door 10 while the van or trailer is in transit by a handle retainer 70 which may be of conventional construction. The retainer 70 may include facilities securable with a padlock or the like to secure the contents of the van or trailer 12 during shipment.

With the handle 52 shown in the position of FIG. 1, the latch member 30 cooperates with the keeper 32 to latch the upper free door edge 28 and the pointed member 36 within the aperture 40 latches the lower free edge 42 of the door 10. The last noted latching may be enhanced by forming the taper on the pointed member 36 in such a way that insertion of the pointed member 36 into the aperture 40 causes the tapered walls of the member 36 to engage or cam against the walls of the aperture 40 so as to force the door 10 in its closed direction. As shown in FIG. 1, with both the upper and lower free edges 28 and 42 of the door 10 latched and the longer leg 54 of the handle 52 held by the retainer 70, the shorter leg 56 of the handle 52 and the link 60 are substantially aligned and are substantially parallel with the axes of the rods 22 and 24.

Removal of the longer leg 54 of the handle 52 from the keeper 70 permits the longer leg 12 to be rotated counterclockwise about an axes which is perpendicular to the axes of the rods 22 and 24 as seen in FIGS. 1 and 2. Such counterclockwise rotation of the longer leg 54 occurs about the pivot 62. This has the effect of moving the pivot 58 upwardly and to the right, raising the link 60 and the pivot 66. Raising of the pivot 66 by upward movement of the link 60 causes the pointed member 36 to be withdrawn from the aperture 40. If a mirror image of the apparatus of FIG. 1 were to be provided on the left-hand door 10, the rotational movement would be reversed, that is, rotation of the longer leg 54 would be clockwise.

With the pointed member 36 having been removed from the aperture 40 the condition of the latch member 30 and the keeper 32 has remained unchanged since the first rod 22 has not yet been rotated. Following removal of the pointed member 36 from the aperture 40, the longer leg 54 of the handle 52 is now rotated about an axis that is coincident with the axes of the rods 22 and 24. This rotation is such as to unlatch the member 30 from the keeper 32 to free the upper edge 28 of the door 10. The door may now be opened because the upper latch member 30 has disengaged the keeper 32 and because the pointed member 36 has been withdrawn from the aperture 40 and beyond the lower door 10 and has been edge 42 so as to not interfere with door movement.

Following opening of the door 10 and loading or unloading of the van or trailer 12, the door 10 is closed and related in the reverse sequence of operation again.

It is possible to follow a different operating sequence when opening the door 10. Specifically, once the longer leg 54 of the handle 52 is freed from the keeper 70, the longer leg 54 may be rotated about the axis coincident with and parallel to the axes of the rods 22 and 24 to unlatch the upper free edge 26 of the door 10 by disengaging the latch member 30 from the keeper 32. Following this action, the longer leg 54 of the handle 52 may be rotated upwardly to remove the pointed member 36 from the aperture 40.

Regardless of the sequence of operation, the rotation of the handle 52 about an axis which is coincident with the pivot point 62 is effective via the various pivots 58, 62 and 66 and members 52 and 60 to remove the pointed member 36 from or to insert the pointed member 36 into the aperture 40. Moreover, rotation of the longer leg 54 about the axis coincident with the axes of the rods 22 and 24, which rotation is achieved by the mechanical connections afforded by the various pivots 60, 62 and 66 to the rods 22 and 24, effect unlatching of the upper free edge 26 of the door 10.

In the preferred embodiment described above, the pointed member 36 is generally coaxial with the second rod 24 and is simply inserted into and withdrawn from the aperture 40. In an alternative embodiment, the pointed member 36 may be made asymmetric or noncoaxial with the second rod 24 so that rotation of the second rod 24 causes off center rotation of the pointed member 36. Off-center rotation may be used to effect a camming force or wedge force between the pointed member 36 and the rear walls of the aperture 40 which applies closing force to the door 10 when the longer leg 54 of the handle 52 is in the position shown in FIG. 1.

Those skilled in the art will appreciate that numerous changes and modifications can be made to the above described apparatus without departing from the spirit or scope of the following claims.

What is claimed is:

1. Apparatus for latching a door closed, the door having upper and lower edges, the apparatus comprising:

(a) first and second elongated rods telescoped together for relative sliding movement;

(b) first means for mounting the first rod to the door with its free end proximate the upper door edge so that the first rod is free to rotate about its longitudinal axis but is prevented from moving longitudinally;

(c) second means for mounting the second rod to the door with its free end proximate the lower door edge so that the second rod is free to rotate about its longitudinal axis and to move longitudinally;

(d) a manipulable operating handle;

(e) linkage means interconnecting the rods and the handle for (i) longitudinally moving the free end of the second rod toward or away from the lower door edge in response to rotation of the handle about an axis which is generally perpendicular to the longitudinal axes of the rods; and (ii) rotating the free ends of the rods in a first or a second direction in response to rotation of the handle in the first or the second direction about an axis which is coincident with the longitudinal axes of the rods;

(f) third means for latching or unlatching the lower edge of the closed door in response to movement of the free end of the second rod toward or away from the lower edge; and (g) fourth means for latching or unlatching the upper edge of the closed door in response to rotation of the free end of the first rod in the first or the second direction.

2. Apparatus as in claim 1, wherein:

the handle comprises:

an L-shaped member, a first leg of which is manipulable; and the linkage means comprises:

a link pivotally connected at one end to the second rod and pivotally connected at its other end to the juncture of the legs of the handle, and a pivotal connection between the free end of the second leg of the handle and the first rod.

3. Apparatus as in claim 2, wherein:

when the free end of the second rod latches the lower door edge, the second leg of the handle and the linke are generally aligned and generally parallel to the rods, and when the free end of the second rod unlatches the lower door edge, the second leg of the handle and the link are not aligned and are not parallel to the rods.

4. Apparatus as in claim 2, wherein:

unlatching or latching of the lower door edge is effected by manipulation of the handle which causes it to rotate about the pivotal connection between its second leg and the first rod, such rotation decreasing or increasing, the distance between such pivotal connection and the pivotal connection between the link and the second rod.

5. Apparatus as in claim 2, wherein:

rotation of the rods is effected by rotative force on the handle which is transferred to the rods via the pivotal connections.

6. Apparatus as in claim 1, wherein:

the third means comprises an aperture formed in a member over which the lower door edge swings as it is opened and closed, the aperture being generally coaxial with the second rod when the door is closed, sufficient movement of the free end of the second rod toward the lower edge of the door causing the free end of the second rod to extend beyond the lower door edge and into the aperture to latch the lower edge.

7. Apparatus as in claim 6, wherein:

the member is substantially coplanar with the plane of movement of the lower door edge.

8. Apparatus as in claim 7, wherein:

the third means further comprises:

a tapered plunger mounted to or formed integrally with the free end of the second rod, the taper ensuring entry of the plunger into the aperture and being shaped so as to act against the wall of the aperture during entry thereof so that the plunger exerts a closing force against the lower door edge.

9. Apparatus as in claim 8, wherein:

the plunger is coaxial with the second rod so that rotation of the second rod does not affect the engagement, or lack thereof, between the plunger and the walls of the aperture.

10. Apparatus as in claim 8, wherein:

the plunger or its taper are not coaxial with the second rod so that rotation of the second rod effects varying amounts of engagement, or lack thereof, between the plunger and the walls of the aperture.

11. Apparatus as in claim 8, wherein:

the member is a liftgate, liftgate extension plate, dock bumper, liftgate platform, or other portion of a van or trailer.

12. Apparatus as in claim 11, wherein the member is coplanar with a floor of the van or trailer.

13. Apparatus as in claim 1, wherein:

the rods, the first through fourth means, the handle, and the linkage means are all on the exterior of the door.

* * * * *